US009908008B2

(12) United States Patent
Fang

(10) Patent No.: US 9,908,008 B2
(45) Date of Patent: Mar. 6, 2018

(54) BALL

(71) Applicant: PEGATRON CORPORATION, Taipei (TW)

(72) Inventor: Yu-Lin Fang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 15/422,017

(22) Filed: Feb. 1, 2017

(65) Prior Publication Data

US 2017/0246513 A1 Aug. 31, 2017

(30) Foreign Application Priority Data

Feb. 26, 2016 (TW) ..... 105105981 A

(51) Int. Cl.

| | |
|---|---|
| ***A63B 43/00*** | (2006.01) |
| ***A63B 43/06*** | (2006.01) |
| ***A63B 71/06*** | (2006.01) |
| ***A63B 41/00*** | (2006.01) |

(52) U.S. Cl.

CPC ..... *A63B 43/06* (2013.01); *A63B 41/00* (2013.01); *A63B 43/004* (2013.01); *A63B 71/0622* (2013.01); *A63B 2041/005* (2013.01); *A63B 2071/0625* (2013.01); *A63B 2071/0633* (2013.01); *A63B 2207/02* (2013.01); *A63B 2209/00* (2013.01); *A63B 2220/56* (2013.01)

(58) Field of Classification Search

CPC ..... A63B 43/06; A63B 41/00; A63B 43/002; A63B 71/0622; A63B 2071/0633; A63B 41/10; A63B 43/004

See application file for complete search history.

(56) References Cited

U.S. PATENT DOCUMENTS

| | | | | | |
|---|---|---|---|---|---|
| 2,020,484 | A | * | 11/1935 | Turner | A63B 43/06 362/190 |
| 3,304,651 | A | * | 2/1967 | Deyerl | A63B 43/06 200/61.47 |
| 4,462,590 | A | * | 7/1984 | Mitchell | A63B 41/08 273/DIG. 8 |
| 4,595,200 | A | * | 6/1986 | Shishido | A63B 43/00 473/570 |
| 4,660,831 | A | * | 4/1987 | Kralik | A63B 41/00 473/603 |
| 5,236,383 | A | * | 8/1993 | Connelly | A63B 43/007 446/219 |

(Continued)

FOREIGN PATENT DOCUMENTS

| | | |
|---|---|---|
| CN | 104548514 A | 4/2010 |
| TW | M378011 U1 | 4/2010 |
| TW | I406695 B1 | 9/2013 |

*Primary Examiner* — Steven Wong

(74) *Attorney, Agent, or Firm* — Muncy, Geissler, Olds & Lowe, P.C.

(57) ABSTRACT

A ball includes a first housing, at least a fixing body, at least a ceramic vibration unit and a second housing. The fixing body is disposed on the internal wall of the first housing. The ceramic vibration unit is configured to make a sound and is fixed on the fixing body. The ceramic vibration unit includes a vibrating plate, a ceramic sheet and a cover body. The ceramic sheet and the cover body are disposed on the vibrating plate, and the ceramic sheet is located between the vibrating plate and the cover body. The second housing covers the first housing.

10 Claims, 6 Drawing Sheets

(56) References Cited

U.S. PATENT DOCUMENTS

| | | | | |
|---|---|---|---|---|
| 5,565,726 | A * | 10/1996 | Toda | H01L 41/0906 310/323.02 |
| 6,971,965 | B1 * | 12/2005 | Shishido | A63B 41/08 473/604 |
| 7,963,820 | B2 | 6/2011 | Ansolabehere | |
| 2007/0281811 | A1 * | 12/2007 | Wang | A63B 43/06 473/570 |
| 2008/0132363 | A1 * | 6/2008 | Harada | A63B 43/06 473/570 |
| 2008/0234077 | A1 | 9/2008 | Glowinski | |
| 2009/0232683 | A1 * | 9/2009 | Hirata | F04B 43/046 417/413.2 |
| 2011/0136604 | A1 * | 6/2011 | Hsu | A63B 43/06 473/609 |
| 2012/0231906 | A1 * | 9/2012 | Barry | A63B 43/004 473/570 |
| 2014/0309063 | A1 | 10/2014 | Molina | |
| 2016/0001137 | A1 * | 1/2016 | Phillips | A63B 43/008 473/570 |
| 2017/0216683 | A1 * | 8/2017 | Fang | A63B 43/06 473/570 |

* cited by examiner

BALL

CROSS REFERENCE TO RELATED APPLICATIONS

This Non-provisional application claims priority under 35 U.S.C. § 119(a) on Patent Application No(s). 105105981 filed in Taiwan, Republic of China on Feb. 26, 2016, the entire contents of which are hereby incorporated by reference.

BACKGROUND

Technology Field

The present disclosure relates to a ball and, in particular, to a ball having a lighting function.

Related Art

Due to the easy access to equipment, ball games become a preferred option for most people in casual activities. Through various ball games, the players can get the appropriate exercise, improved blood circulation, and joys in the ball games, thereby maintaining physical and spiritual health.

With the development of technologies, the demands of modern people for ball games become more and more technology and diversification. Therefore, it is possible to increase the interactive effect with the user and the existing ball so as to increase the entertainment and joy of the ball games. Accordingly, many interactive balls, which can emit light or output sound, are invented.

In general, the conventional speaker is installed inside the ball for making sound. In order to transmit the sound out of the ball, the sound holes disposed on the ball are necessary, or a high power speaker is required. However, the above methods also accompany with some undesired drawbacks. For example, the former method needs a more complex manufacturing process, while the later method will increase the weight of the ball so that the ball may not properly jump or roll linearly. Moreover, the traditional speaker has high power consumption, so that the ball can't normally operate for a longer time.

Therefore, it is an important subject to provide a ball having a sound effect, which can be easily manufactured without increasing the total weight of the ball, thereby guaranteeing the normal jumping and rolling route of the ball.

SUMMARY

In view of the foregoing, an objective of the present disclosure is to provide a ball having a sound effect, which can be easily manufactured without increasing the total weight of the ball, thereby guaranteeing the normal jumping and rolling route of the ball.

To achieve the above objective, the present disclosure discloses a ball including a first housing, at least one fixing body, at least one ceramic vibration unit and a second housing. The fixing body is disposed on the internal wall of the first housing. The ceramic vibration unit is configured to make a sound and is fixed on the fixing body. The ceramic vibration unit includes a vibrating plate, a ceramic sheet and a cover body. The ceramic sheet and the cover body are disposed on the vibrating plate, and the ceramic sheet is located between the vibrating plate and the cover body. The second housing covers the first housing.

In one embodiment, the fixing body has a plurality of fixing members, the vibrating plate and the cover body have a plurality of holes, and the holes of the vibrating plate are disposed corresponding to the holes of the cover body so as to form a plurality of connecting structures. The connecting structures are connected with the fixing members so as to fix the ceramic vibration unit on the fixing body.

In one embodiment, the ball further includes at least a balance unit, and the ceramic vibration unit and the balance unit are symmetrically disposed on the internal wall of the first housing.

In one embodiment, the ball further includes at least six light emitting structures symmetrically disposed on the first housing. Each of the light emitting structures includes a fixing unit, a light emitting unit and a first light permeable unit. The fixing unit is disposed on the first housing, and the light emitting unit and the first light permeable unit are disposed on the fixing unit. The light emitting unit is located between the fixing unit and the first light permeable unit.

In one embodiment, the ball further includes a woven structure located between the first housing and the second housing. The woven structure includes a plurality of woven units, which are at least partially overlapped and covering the first housing.

In one embodiment, the second housing includes a first material layer, a second material layer and at least six second light permeable units. The first material layer is light permeable. The second material layer is covered by the first material layer. The at least six second light permeable units are disposed on the second material layer corresponding to positions of the light emitting structures.

In one embodiment, the first housing has a plurality of first through holes communicating the internal wall and an external wall of the first housing, and the light emitting structures are disposed in the first through holes, respectively.

In one embodiment, any three of the light emitting units define a region of the same size.

In one embodiment, the woven units are at least partially overlapped at a region outside the light emitting structure.

In one embodiment, the second material layer has a plurality of second through holes communicating an internal wall of the second material layer and an internal wall of the first material layer.

In one embodiment, the second light permeable units are disposed in the second through holes, respectively, and contact with the first material layer.

As mentioned above, the ball of the disclosure has standard size, and the first housing (bladder) and the second housing (ball skin) of the ball are configured with at least one ceramic vibration unit for making sound. The vibration of the vibrating plate of the ceramic vibration unit can be transmitted to the entire ball through the fixing body attached to the first housing, thereby making a special sound. Compared with the conventional approach that uses the speaker to output sound, the ceramic vibration unit of this disclosure has lighter weight, so that the ball can still normally jump and roll linearly. Besides, the disclosure also has an advantage of lower power consumption.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

To be noted, the ball of the following embodiment is a soccer ball as an example, and the ball fits the standard specifications of soccer ball. In practice, the ball of the invention can be a basketball, a soccer ball, a volleyball, a toy ball, or the likes. In addition, the term "connecting" includes the directly or indirectly connection between components. For example, if an intermediate or an additional component is configured between the two components, they are defined in "indirectly connection". In order to emphasize the concept of the invention, some well-known components will be omitted in the following descriptions.

Figure 1:
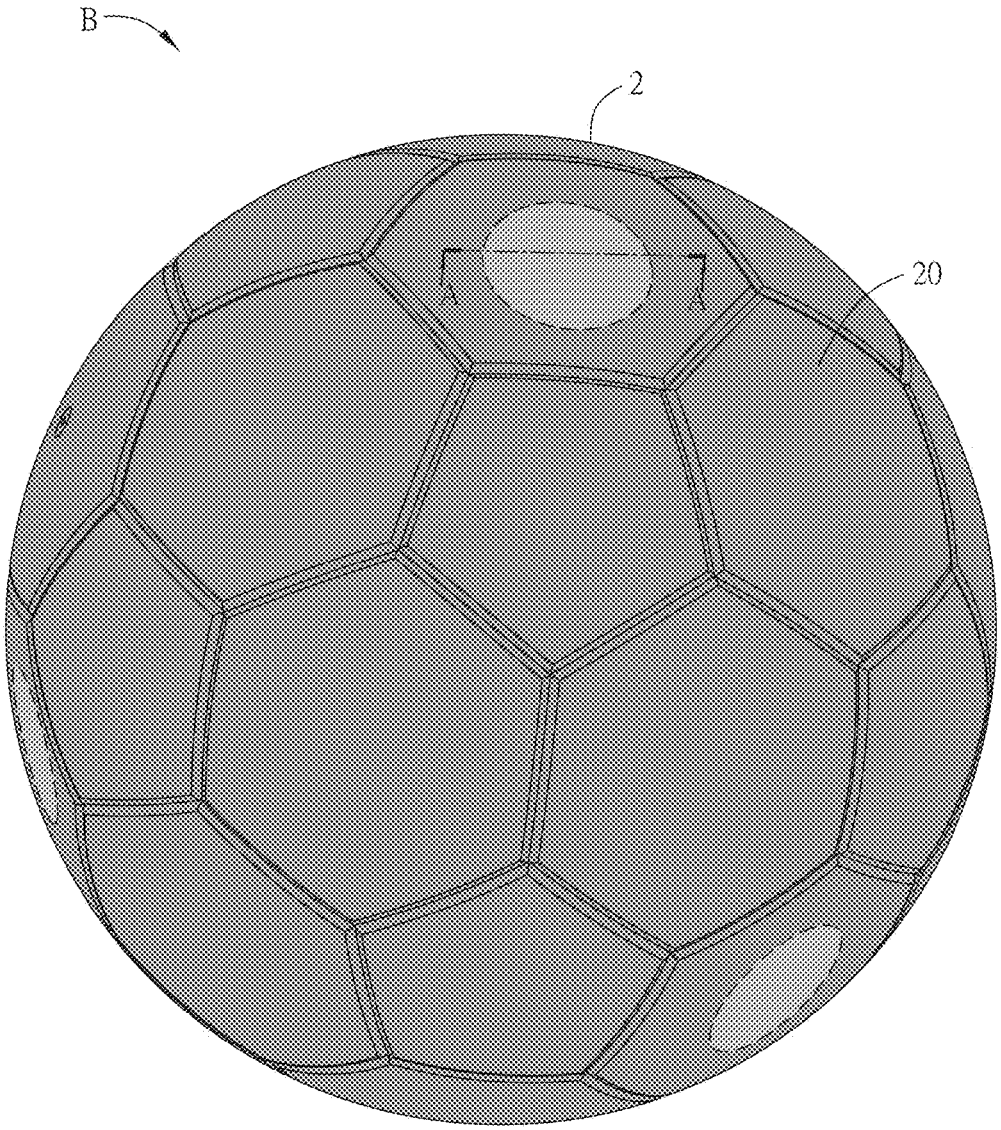
FIG. 1 is a schematic diagram of a ball according to an embodiment of the invention.
Figure 2:
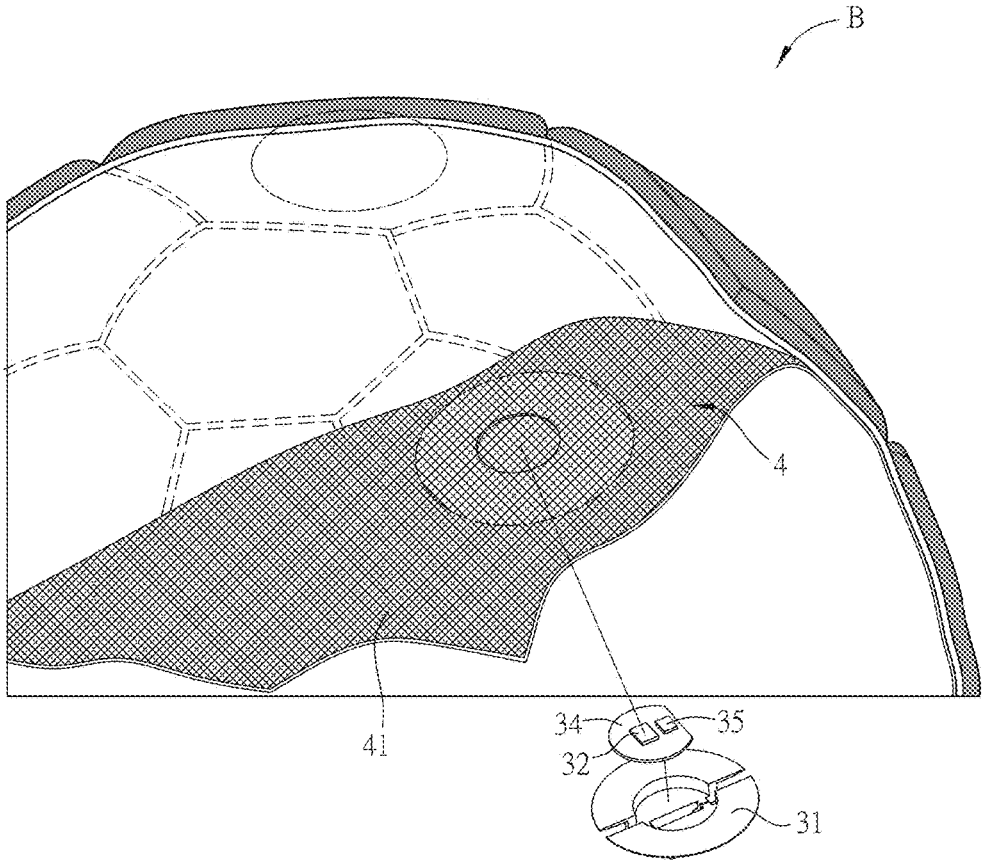
FIG. 2 is a perspective view of the ball of FIG. 1, including an exploded part of the ball.
Figure 3:
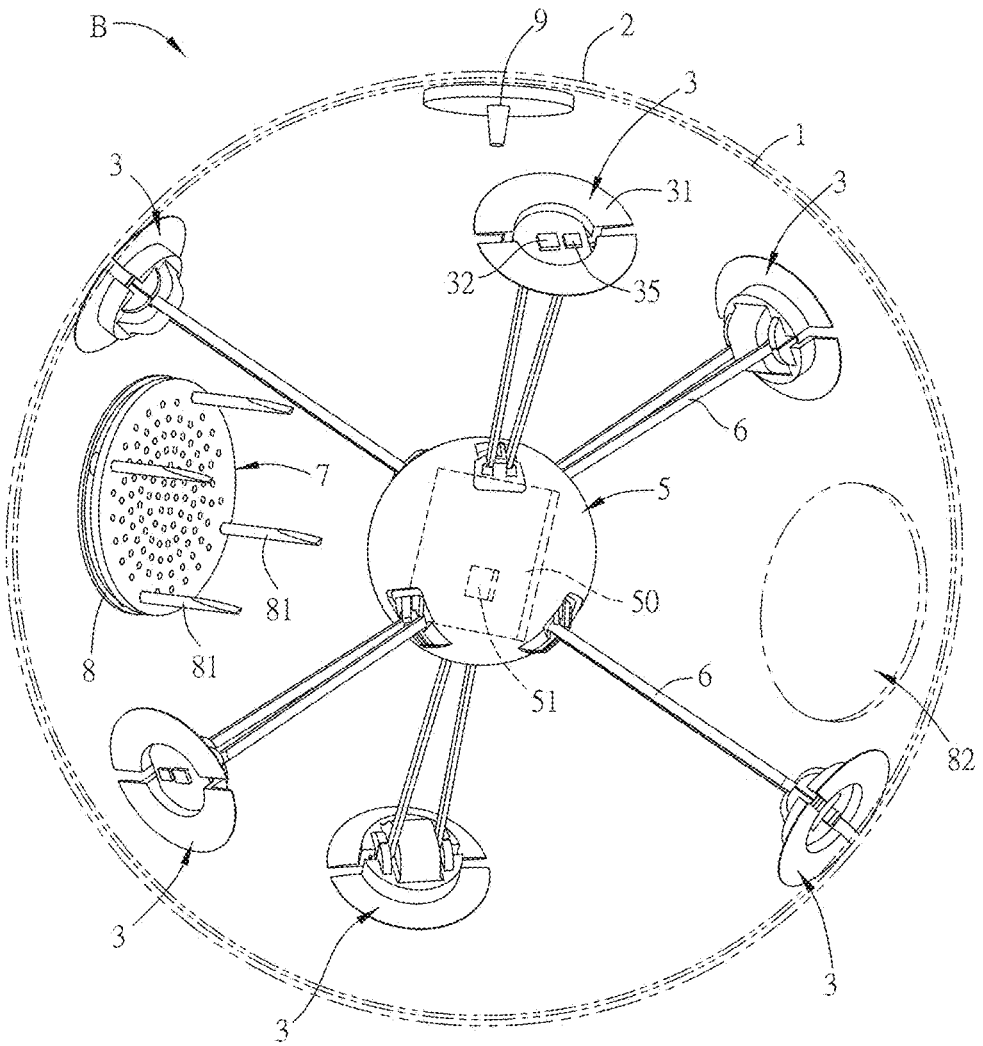
FIG. 3 is a perspective view of the ball of FIG. 1.

FIG. 1 is a schematic diagram of a ball according to an embodiment of the invention, FIG. 2 is a perspective view of the ball of FIG. 1, including an exploded part of the ball, and FIG. 3 is a perspective view of the ball of FIG. 1. Since FIG. 3 is to describe the major structure inside the ball B of the embodiment, some miner parts of the ball B are not labeled in FIG. 3.

Referring to FIGS. 1 to 3, the ball B includes a first housing 1 and a second housing 2. In this embodiment, the first housing 1 is a hollow bladder of a soccer ball, and the second housing 2 is a ball skin of the soccer ball. The first housing 1 and the second housing 2 of the ball B of the invention are modified, so that the ball B can have more applications. The detailed structures of the ball B will be described hereinafter.

In order to make the ball B having the lighting effect, the ball B includes at least six light emitting structures 3, which are symmetrically disposed on the first housing 1. The first housing 1 has a plurality of first through holes 11 communicating the internal wall and external wall of the first housing 1, and the light emitting structures 3 are disposed and fixed in the first through holes 11, respectively. In this embodiment, any three of the light emitting structures 3 define a region of the same size, thereby properly distributing the light emitting structures 3 on the first housing 1 so as to maintain the balance of the ball B. Of course, in other embodiments, the amount of the light emitting structures 3 can be an even number more than six (e.g. 8, 10, 12 or more) depending on the required lighting effect.

Figure 4:
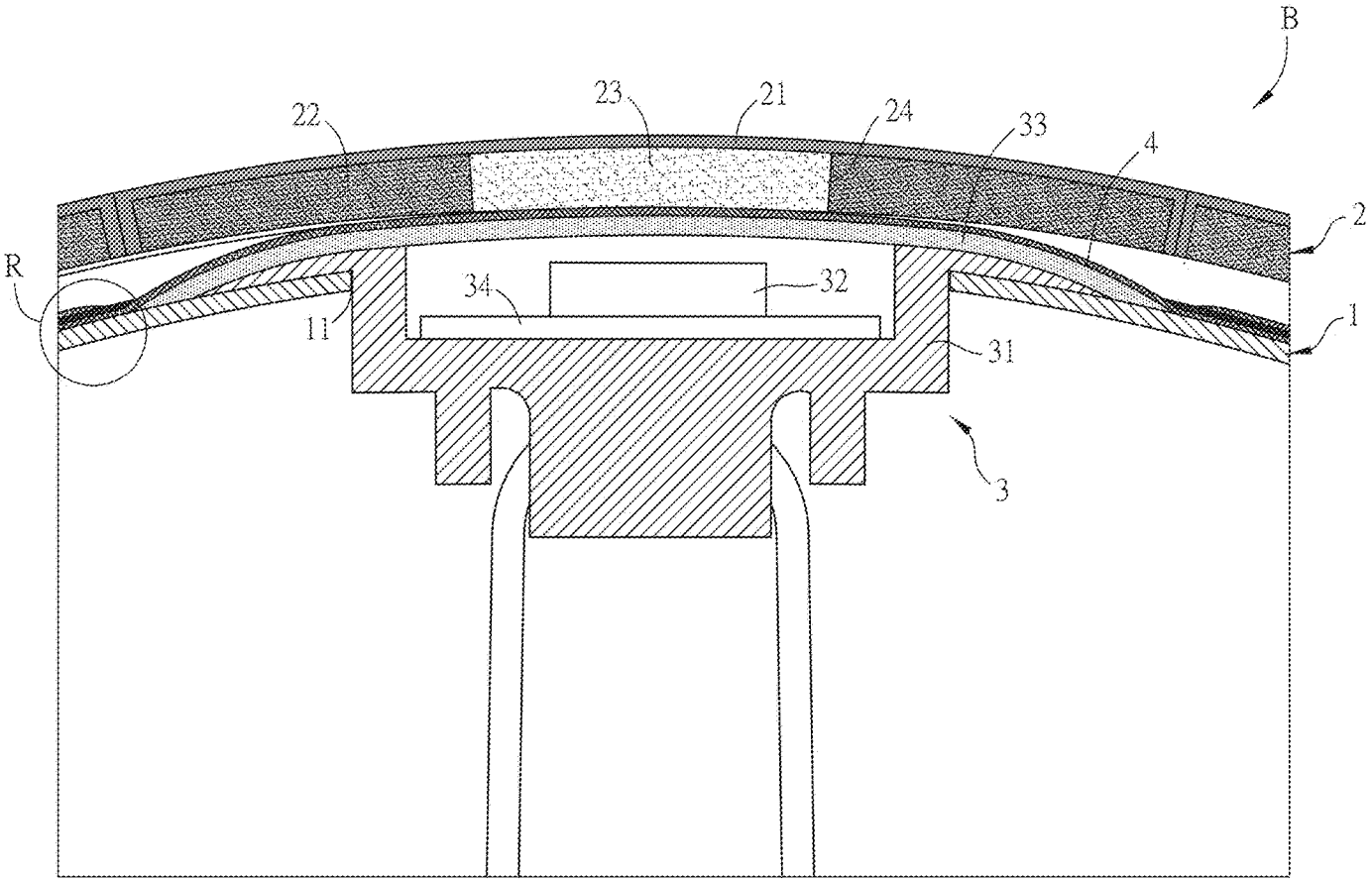
FIG. 4 is a sectional view of the ball of FIG. 1 along the line A-A.

FIG. 4 is a sectional view of the ball B of FIG. 1 along the line A-A. With reference to FIGS. 1 to 4, each light emitting structure 3 includes a fixing unit 31, a light emitting unit 32, and a first light permeable unit 33. In this embodiment, the light emitting structure 3 is disposed in the first through hole 11 by the fixing unit 31 for carrying the light emitting structure 3. The light emitting unit 32 is disposed on a first circuit board 34, and the first circuit board 34 is disposed on the fixing unit 31 by adhering, stitching, or welding. The first light permeable unit 33 is disposed on the fixing unit 31. The light emitting unit 32 is located between the fixing unit 31 and the first light permeable unit 33. The first light permeable unit 33 is configured for isolating and protecting the light emitting unit 32. In order to allow the light emitted from the light emitting unit 32 to penetrate the ball B, the first light permeable unit 33 is made of natural rubber, latex, silicone, synthetic rubber, or combinations thereof. Of course, the first light permeable unit 33 can be made of the material that is totally or partially light permeable, and this invention is not limited.

In addition, the type of the light emitting unit 32 is not limited in this invention. For example, the light emitting unit 32 can be an SMD (surface mount device) LED package, LED die or the likes. In this embodiment, the light emitting unit 32 is an SMD LED package having a single LED die. Of course, the number of the LED dies is not limited. For example, the SMD LED package may have two, through or more dies. This can be determined depending on the required lighting effect.

Referring to FIGS. 2 to 4, the ball B further includes a woven structure 4. The woven structure 4 includes a plurality of woven units 41, which are at least partially overlapped and covering the first housing 1. In other words, the woven units 41 are at least partially overlapped to form the woven structure 4, and the woven structure 4 covers the entire external wall of the first housing 1. In more detailed, in order to allow the light emitted from the light emitting unit 32 to penetrate the ball B, the woven units 41 are at least partially overlapped on the area (area R of FIG. 4) other than the light emitting structure 3. That is, the woven structure 4 has only a single woven unit 41 at the position corresponding to the light emitting structure 3. The configuration of the woven structure 4 can maintain the rigidity of the ball B. Moreover, the configurations of the light permeable materials and the single-layer woven unit 41 can effectively solve the issue of blocking the light emitted from the light emitting structure 3 by the opaque materials.

The second housing 2 covers the woven structure 4. The second housing 2 includes a first material layer 21, a second material layer 22, and at least six second light permeable units 23. To be noted, the second housing 2 is actually configured by multiple patches 20, which are combined by adhering, stitching or welding. The shape of the patches 20 can be a pentagon or hexagon.

The detailed structure of the second housing 2 will be described hereinafter. The In this embodiment, the first material layer 21 covers the second material layer 22, and the second light permeable units 23 are disposed on the second material layer 22 corresponding to the positions of the light emitting structures 3. Herein, the first material layer 21 may include TPU (thermoplastic polyurethane) or PU (polyurethane), and the second material layer 22 may include foam. The materials of the first material layer 21 and the second material layer 22 are not limited in this invention. Generally, the first material layer 21 is made of a material with high wearing resistance. The second material layer 22 is made of a material with good elasticity (fitting the elasticity requirement for the ball B).

In order to allow the light emitted from the light emitting structures 3 to penetrate the ball B, the second material layer 22 of the ball B is designed with a plurality of second through holes 24, which communicate the internal wall of the second material layer 22 and the internal wall of the first material layer 21. The second light permeable units 23 are disposed in the second through holes 24, respectively, and contact the first material layer 21. Similar to the first light permeable unit 33, the second light permeable unit 23 can also be made natural rubber, latex, silicone, synthetic rubber, or combinations thereof. Of course, the second light permeable unit 23 can be made of the material that is totally or partially light permeable, and this invention is not limited.

As mentioned above, based on the design of the second housing 2, the light emitted from the light emitting units 32 can pass through the first light permeable unit 33, the second light permeable unit 23 and the first material layer 21 in order. Then, the users surrounding the ball B can catch the emitted light, thereby increasing the vision effect and joy as playing the ball B.

Figure 5:
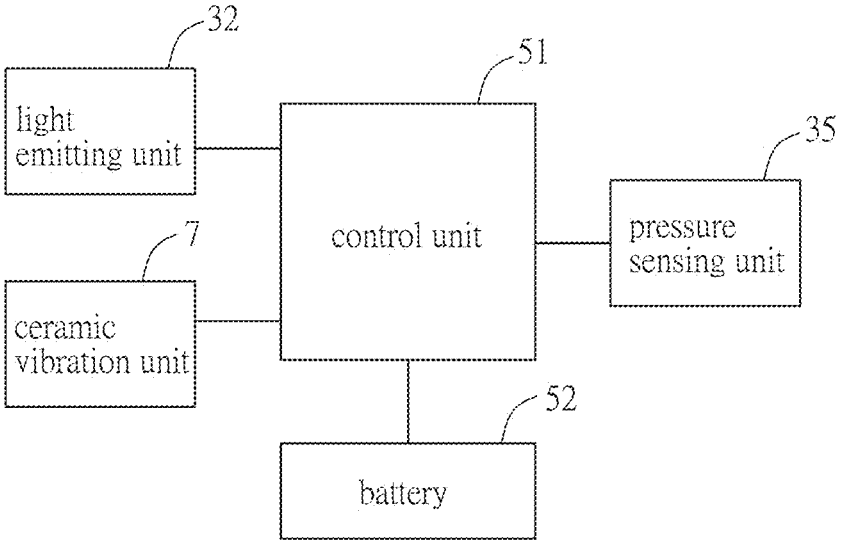
FIG. 5 is a block diagram showing the circuit of the ball of FIG. 1.

FIG. 5 is a block diagram showing the circuit of the ball B of FIG. 1. Referring to FIGS. 3 and 5, the ball B further includes a third housing 5 and a plurality of connecting members 6. The third housing 5 is located inside the first housing 1, and two ends of each connecting member 6 are connected to the fixing unit 31 and an external wall of the third housing 5, respectively. In more detailed, the connecting members 6 can provide stretching forces between the third housing 5 and the fixing unit 31, and the positions of the connecting members 6 can be well designed so that the sum of the total stretching forces is substantially equal to zero. Accordingly, no matter the ball B is in which rolling angle, the housing 5 can be in a static balance status. Preferably, after the ball B gets an impact (e.g. kicked by a foot), the connecting members 6 can provide a recovery force to the ball B so as to return the ball B back a preset position.

The application of the ball B will be illustrated hereinafter. Referring to FIGS. 2 and 3, each light emitting structure 3 further includes a pressure sensing unit 35, which is disposed on the first circuit board 34 and adjacent to the light emitting unit 32. The pressure sensing unit 35 can sense the pressure change inside the ball B as the ball B is flapped, kicked or collided, so that the ball B can be applied to various sports or games. In this embodiment, a second circuit board 50 is disposed inside the third housing 5. The second circuit board 50 includes a control unit 51 electrically connected to the light emitting units 32 for controlling the light emitting units 32 to emit light.

As mentioned above, when an area of the ball B is flapped, kicked or collided, the pressure sensing unit 35 corresponding to this area can sense the pressure change of this area of the ball B. Then, the pressure sensing unit 35 sends a signal corresponding to the pressure change to the control unit 51, and the control unit 51 generates a control instruction corresponding to the signal and sends the control instruction to the light emitting unit 32 corresponding to this area. Accordingly, the light emitting unit 32 corresponding to this area can emit light based on the control instruction. In practice, when the user flaps or kicks the ball B, the flapped or kicked portion of the ball B can emit light, so that the ball B can provide more funny vision effect.

Figure 6:
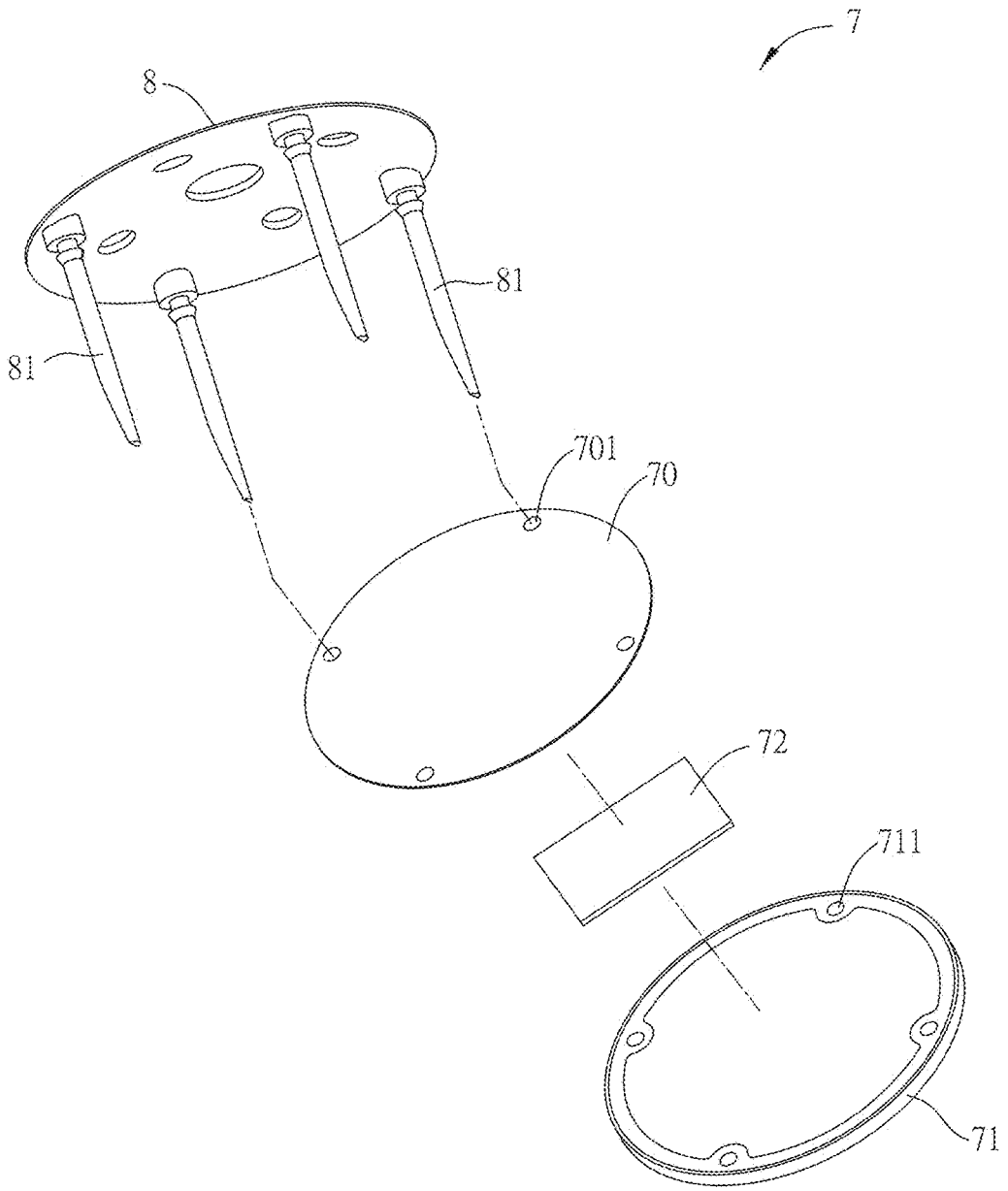
FIG. 6 is an exploded view of a part of the ball of FIG. 1.

In addition, the ball B further includes at least one ceramic vibration unit 7. Referring to FIGS. 3 and 6, the ceramic vibration unit 7 is disposed on the internal wall of the first housing 1. In this embodiment, the ceramic vibration unit 7 is a ceramic vibration speaker. The ceramic vibration unit 7 includes a cover 71, a vibrating plate 70, and ceramic sheets 72 printed thereon. The ceramic sheets 72 are disposed between the cover 71 and the vibrating plate 70. In another embodiment of the invention, two sides of the vibrating plate 70 are both configured with the ceramic sheets 72, respectively. Each of the cover 71 and the vibrating plate 70 has a plurality of holes 701 and 711. When the cover 71 is assembled with the vibration unit 71, the holes 701 and 711 are disposed correspondingly and form a plurality of connecting structures (four connecting structures for this embodiment). The connecting structure can be connected to a plurality of fixing members 81 of a fixing body 8, and then the fixing body 8 are attached to the internal wall of the first housing 1. Accordingly, the ceramic vibration unit 7 can be fixed on the internal side wall of the first housing 1.

To be noted, the ball B further includes a balance unit 82, and the ceramic vibration unit 7 and the balance unit 82 are symmetrically disposed on the internal wall of the first housing 1. The position of the ceramic vibration unit 7 is configured corresponding to the light emitting structure 3, so that the ball B can act as a normal ball for jumping and rolling. In one embodiment, the balance unit 82 and the ceramic vibration unit 7 have the same weight.

The ceramic vibration unit 7 is electrically connected to the control unit 51 for generating a sound effect according to the control instruction of the control unit 51. In more detailed, when the user flaps or kicks the ball B, the pressure sensing unit can sense the pressure change of the ball B and send a signal corresponding to the pressure change to the control unit 51, and then the control unit 51 sends a control instruction corresponding to the signal to the ceramic vibration unit 7. Accordingly, the ceramic vibration unit 7 can generate the sound effect based on the control instruction. Thus, when the user flaps or kicks the ball B, the flapped or kicked portion of the ball B will emit light, and the ball B can also generate a proper sound. As a result, the ball B can provide funny vision and hearing effects.

As mentioned above, the ceramic vibration unit 7 is configured for outputting a sound. The vibrating plate 70 of the ceramic vibration unit 7 is vibrated, and the vibration can be transmitted through the fixing body 8 to the entire ball B. That is, the ceramic vibration unit 7 can make a sound by the vibration of the vibrating plate 70 as well as the other components of the ball B, and the speaker is not necessary. Moreover, the ceramic vibration unit 7 is very light, so it will not affect the jumping and rolling of the ball B. In addition, the ceramic vibration unit 7 has small power consumption, so the lifetime of the battery can be longer.

The ball B further includes a battery 52 as shown in FIG. 5. The battery 52 is disposed on the second circuit board 50 and electrically connected with the control unit 51. The battery 52 can provide the power to the electronic components of the ball B through the control unit 51. The battery 52 can be a primary battery (non-rechargeable) or a rechargeable battery, and this invention is not limited. Preferably, the battery 52 is a wirelessly rechargeable battery.

As shown in FIG. 3, the ball B further includes an air hole 9, which tightly disposed through the first housing 1 and the second housing 2. When the ball B is needed to be inflated, it is possible to pump air into the ball B through the air hole 9.

As mentioned above, the ball of the invention has standard size, and the first housing (bladder) and the second housing (ball skin) of the ball are configured with at least one ceramic vibration unit for making sound. The vibration of the vibrating plate of the ceramic vibration unit can be transmitted to the entire ball through the fixing body attached to the first housing, thereby making a special sound. Compared with the conventional approach that using the speaker to output sound, the ceramic vibration unit of this invention has lighter weight, so that the ball can still normally jump and roll linearly. Besides, the invention also has an advantage of lower power consumption.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A ball, comprising:

a first housing;

at least a fixing body disposed on an internal wall of the first housing;

at least a ceramic vibration unit configured to make a sound and fixed on the fixing body, wherein the ceramic vibration unit comprises:

a vibrating plate, a ceramic sheet disposed on the vibrating plate, a cover body disposed on the vibrating plate, wherein the ceramic sheet is located between the vibrating plate and the cover body; and a second housing covering the first housing;

wherein the fixing body has a plurality of fixing members, the vibrating plate and the cover body have a plurality of holes, the holes of the vibrating plate are disposed corresponding to the holes of the cover body so as to form a plurality of connecting structures, and the connecting structures are connected with the fixing members so as to fix the ceramic vibration unit on the fixing body.

2. The ball of claim 1, further comprising:

at least a balance unit, wherein the ceramic vibration unit and the balance unit are symmetrically disposed on the internal wall of the first housing.

3. The ball of claim 1, further comprising:

at least six light emitting structures symmetrically disposed on the first housing, wherein each of the light emitting structures comprises:

a fixing unit disposed on the first housing;

a light emitting unit disposed on the fixing unit; and a first light permeable unit disposed on the fixing unit, wherein the light emitting unit is located between the fixing unit and the first light permeable unit.

4. The ball of claim 1, further comprising:

a woven structure located between the first housing and the second housing, wherein the woven structure comprises a plurality of woven units, which are at least partially overlapped and covering the first housing.

5. The ball of claim 3, wherein the second housing comprises:

a first material layer being light permeable;

a second material layer covered by the first material layer; and at least six second light permeable units disposed on the second material layer corresponding to positions of the light emitting structures.

6. The ball of claim 3, wherein the first housing has a plurality of first through holes communicating the internal wall and an external wall of the first housing, and the light emitting structures are disposed in the first through holes, respectively.

7. The ball of claim 3, wherein any three of the light emitting units define a region of the same size.

8. The ball of claim 3, wherein the woven units are at least partially overlapped at a region outside the light emitting structure.

9. The ball of claim 5, wherein the second material layer has a plurality of second through holes communicating an internal wall of the second material layer and an internal wall of the first material layer.

10. The ball of claim 9, wherein the second light permeable units are disposed in the second through holes, respectively, and contact with the first material layer.

* * * * *